US009334868B2

(12) United States Patent
Huang et al.

(10) Patent No.: US 9,334,868 B2
(45) Date of Patent: May 10, 2016

(54) FAN

(71) Applicant: DELTA ELECTRONICS, INC., Taoyuan Hsien (TW)

(72) Inventors: Shih-Han Huang, Taoyuan Hsien (TW); Shun-Chen Chang, Taoyuan Hsien (TW)

(73) Assignee: DELTA ELECTRONICS, INC., Taoyuan Hsien (TW)

( * ) Notice: Subject to any disclaimer, the term of this patent is extended or adjusted under 35 U.S.C. 154(b) by 215 days.

(21) Appl. No.: 14/074,095

(22) Filed: Nov. 7, 2013

(65) Prior Publication Data

US 2015/0044077 A1 Feb. 12, 2015

(30) Foreign Application Priority Data

Aug. 7, 2013 (CN) ..... 2013 1 0341962

(51) Int. Cl.
*F04D 25/08* (2006.01)
*F04D 29/58* (2006.01)

(52) U.S. Cl.
CPC ..... *F04D 25/082* (2013.01); *F04D 29/584* (2013.01); *F04D 29/5806* (2013.01)

(58) Field of Classification Search
CPC ..... F04D 17/16; F04D 25/06; F04D 25/064; F04D 25/08; F04D 25/082; F04D 29/5806; F04D 29/584; H02K 9/04; H02K 9/06
USPC ..... 417/423.8; 310/12.29, 16
See application file for complete search history.

(56) References Cited

U.S. PATENT DOCUMENTS

| | | | | |
|---|---|---|---|---|
| 4,337,406 | A * | 6/1982 | Binder | 310/91 |
| 4,838,760 | A * | 6/1989 | Brackett | F04D 25/082 416/183 |
| 5,967,764 | A * | 10/1999 | Booth | H02K 9/06 416/169 A |
| 7,507,068 | B2 * | 3/2009 | Lin | F04D 25/082 415/176 |
| 2006/0051221 | A1 * | 3/2006 | Chen et al. | 417/423.8 |
| 2008/0218011 | A1 * | 9/2008 | Cosco et al. | 310/71 |
| 2009/0148086 | A1 * | 6/2009 | Kuo et al. | 384/440 |
| 2009/0196762 | A1 * | 8/2009 | Koga | 416/241 R |

* cited by examiner

*Primary Examiner* — Nathan J Newhouse
*Assistant Examiner* — Connor Tremarche
(74) *Attorney, Agent, or Firm* — Muncy, Geissler, Olds & Lowe, P.C.

(57) ABSTRACT

A fan includes a motor, an impeller and a heat dissipating structure. The impeller includes a hub and a plurality of first blades. The hub receives the motor, and the hub comprises at least a heat dissipating hole. The first blades are disposed around the hub. The heat dissipating structure is disposed outside the hub. The heat dissipating structure includes a baffle and at least a second blade extending from the baffle and disposed corresponding to the heat dissipating hole.

13 Claims, 6 Drawing Sheets

FAN

CROSS REFERENCE TO RELATED APPLICATIONS

This Non-provisional application claims priority under 35 U.S.C. §119(a) on Patent Application No(s). 201310341962.9 filed in People's Republic of China on Aug. 7, 2013, the entire contents of which are hereby incorporated by reference.

BACKGROUND OF INVENTION

1. Field of Invention

The invention relates to a fan and, in particular, to a fan having a heat dissipating structure.

2. Related Art

In a general structure of a fan, the impeller is coupled to the motor and driven by the motor to rotate so as to supply sufficient airflow volume to the heat generating device or space for the purpose of heat dissipation. So, the current fan designers and manufacturers make efforts in the kind of fan that can provide more airflow. One way to increase the airflow of the fan is to raise the rotation speed of the fan. However, when the fan rotates at a high speed, the blades of the fan will bear extremely high pressure and may be thus deformed and even broken, resulting in a very dangerous situation. Thus, the rotation speed can not be raised unlimitedly in the design of the fan.

Besides, at the high-speed rotation, the motor's structure and bearings will be subjected to a large burden, which heavily threatens the lifespan of the product. Moreover, because the motor is disposed within the impeller, the heat generated by the motor can not be smoothly dissipated due to the impediment of the impeller. In this situation, the bearings of the motor will be easily damaged and the lifespan of the motor is thus reduced. Besides, the temperature within the system will increase accordingly and the lifespan of the fan is thus reduced.

Furthermore, some fans that can generate high airflow pressure, such as centrifugal fans, are commonly applied to a heat dissipating apparatus of a complex system, such as a communication cabinet or a frequency converter cabinet, and these heat dissipating apparatuses will generate an environment up to 70° C. The temperature of the motor operating in the 70° C. environment will reach 100° C., which will reduce the lifespan of the motor's bearing a lot.

SUMMARY OF THE INVENTION

In view of the foregoing subject, an objective of the invention is to provide a fan that has a heat dissipating structure for the motor, and therefore the heat generated by the motor during the operation can be effectively dissipated. Thus, the motor can operate in an appropriate temperature environment in order to increase the lifespan and safety of the motor and fan.

To achieve the above objective, a fan according to the invention includes a motor, an impeller and a heat dissipating structure. The impeller includes a hub and a plurality of first blades. The hub is used for accommodating the motor, and the hub has at least one heat dissipating hole. The first blades are disposed around the hub. The heat dissipating structure is disposed outside the hub. The heat dissipating structure includes a baffle and at least one second blade extending from the baffle and disposed corresponding to the heat dissipating hole.

In one embodiment, the hub includes at least a recess extending from the heat dissipating hole and the second blade is wedged in the recess.

In one embodiment, the second blade is partially disposed in the recess and partially disposed over the heat dissipating hole.

In one embodiment, the shape of the recess is corresponding to that of the bottom of the second blade.

In one embodiment, the hub includes at least one first fixing portion, the heat dissipating structure includes at least one second fixing portion, and the first fixing portion is connected to the second fixing portion.

In one embodiment, the first fixing portion and the second fixing portion are connected to each other by screwing, riveting or soldering.

In one embodiment, the first blade and the second blade are curvature-type blades.

In one embodiment, the curvature directions of the first and second blades are the same.

In one embodiment, the impeller further includes two annular structures, the first blades are disposed between the annular structures, and one of the annular structures is connected to the hub.

In one embodiment, one of the annular structures has a plurality of screw holes and is connected to the hub in a screwing way.

In one embodiment, the annular structure connected to the hub includes an inclined surface.

In one embodiment, the hub includes a shaft and an iron shell.

In one embodiment, the shaft and the iron shell are integrally formed as one piece with a main body of the hub by die-casting.

In one embodiment, the material of the hub includes a light metal or aluminum.

In one embodiment, the fan further includes a base, the motor is disposed on the base, and the motor and the base define an accommodating space for accommodating an electronic component.

As mentioned above, due to the design of the heat dissipating hole formed on the hub of the fan and the heat dissipating structure disposed outside the hub in the present invention, the heat dissipating structure as well as its inner blades are driven to rotate as the motor drives the hub to rotate, resulting in the convection effect within the motor and area of the hub to generate the second airflow. Accordingly, the heat generated by the motor can be dissipated out through the heat dissipating hole, the coil of the motor can be heat-dissipated, and the temperature of the bearing can be lowered down. Therefore, the lifespan of the motor and its bearing can be increased.

Furthermore, the air within the motor is guided by the second airflow due to the rotation of the impeller. Thus, the stagnant region and turbulence with the accompanying noise can be diminished in the invention in comparison with the conventional fan. Because the second airflow generated by the inner blades concerns the internal disturbance of the fan, the power consumption resulted from the second airflow is negligible. Therefore, the disposition of the heat dissipating structure won't affect the characteristic of the fan and increase the additional power consumption.

Moreover, besides dissipating the heat generated by the motor, the disposition of the heat dissipating holes also can decrease the total weight of the hub.

BRIEF DESCRIPTION OF THE DRAWINGS

The invention will become more fully understood from the detailed description and accompanying drawings, which are given for illustration only, and thus are not limitative of the present invention, and wherein.

DETAILED DESCRIPTION OF THE INVENTION

The present invention will be apparent from the following detailed description, which proceeds with reference to the accompanying drawings, wherein the same references relate to the same elements.

Figure 1A:
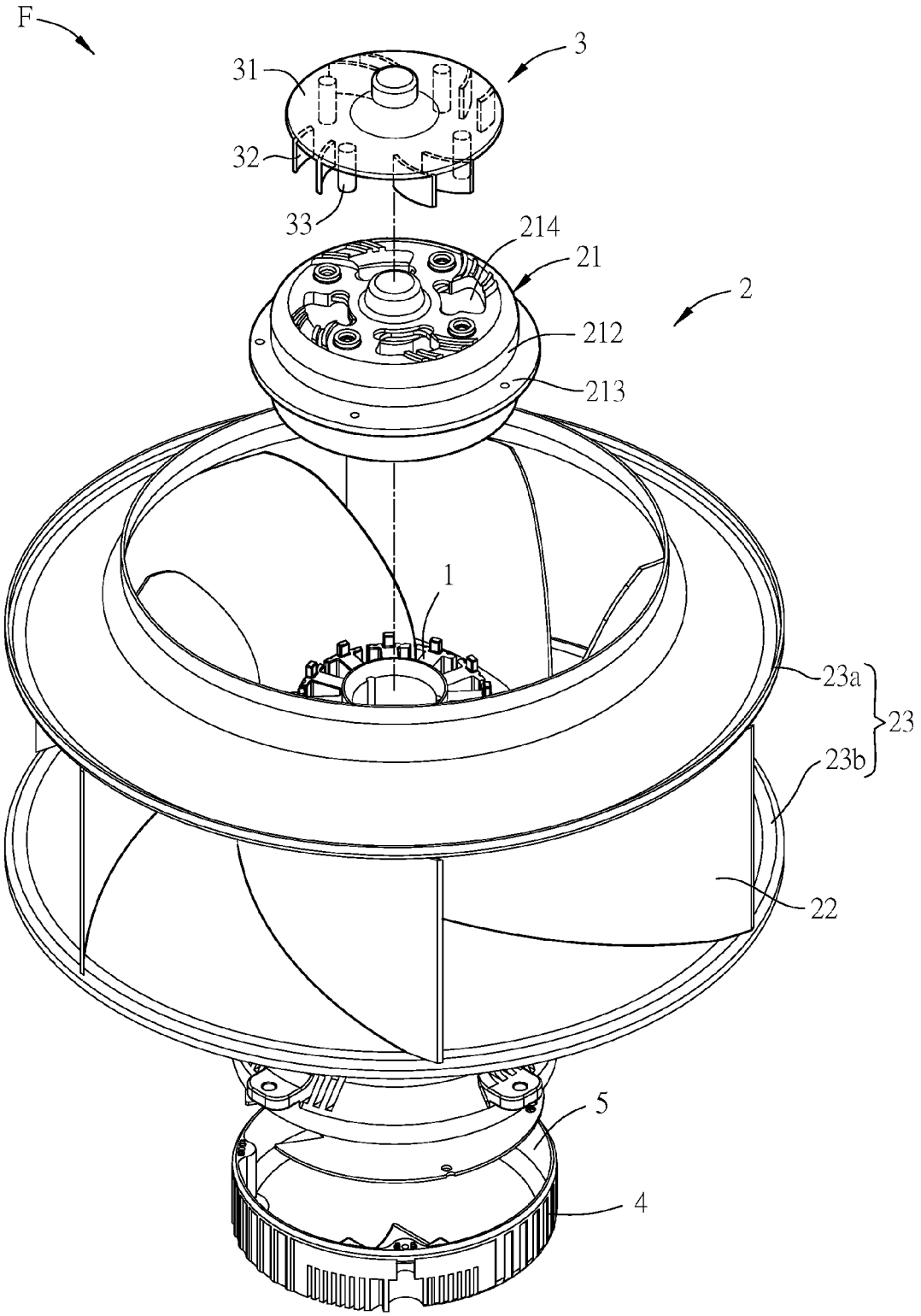
FIG. 1A is an exploded diagram of a fan according to an embodiment of the invention.
Figure 1B:
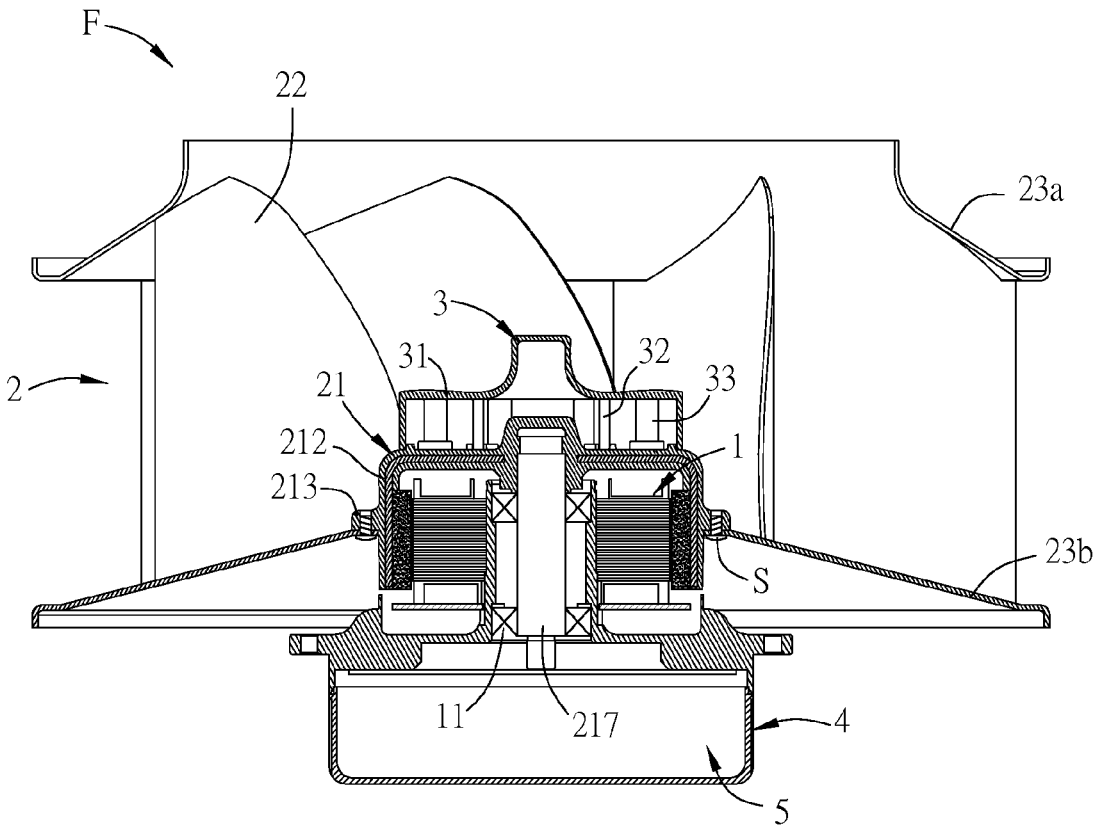
FIG. 1B is a sectional diagram of the fan in FIG. 1A.
Figure 2:
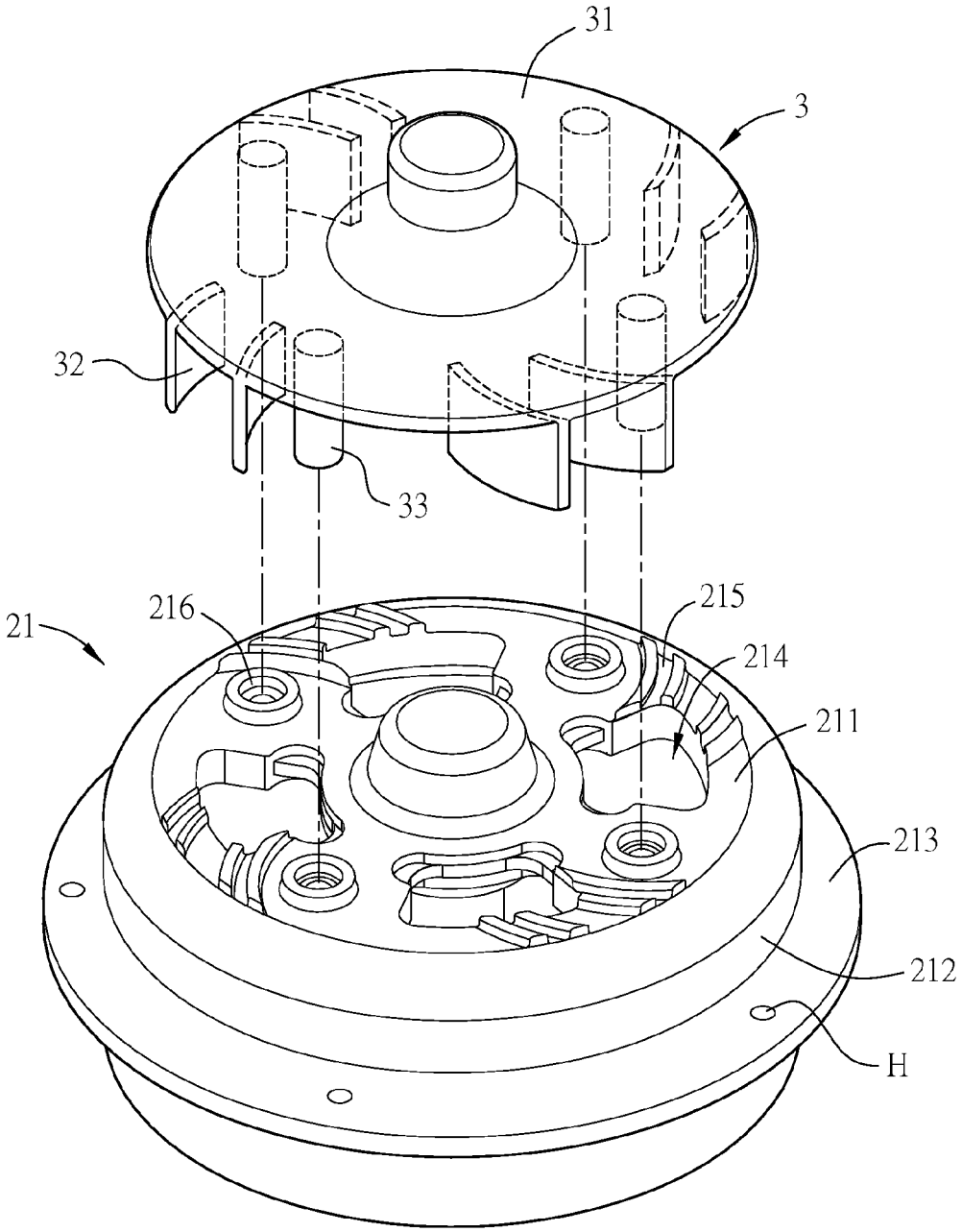
FIG. 2 is an enlarged diagram of the hub and heat dissipating structure in FIG. 1A.

FIG. 1A is an exploded diagram of a fan according to an embodiment of the invention, and FIG. 1B is a schematic sectional diagram of the fan in FIG. 1A. As shown in FIGS. 1A and 1B, the fan F includes a motor 1, an impeller 2 and a heat dissipating structure 3. The impeller 2 includes a hub 21 and a plurality of outer blades (or called first blades) 22. The hub 21 is a hollow structure and can accommodate the motor 1. The hub 21 can be divided into a top portion 211 and a surrounding wall 212, as shown in FIG. 2. In FIGS. 1A and 1B, the impeller 2 further includes two annular structures 23, and the outer blades 22 are disposed between the annular structures 23. Besides, one of the annular structures 23 is connected to the surrounding wall 212 of the hub 21. In this embodiment, the annular structure 23 comprises an upper annular structure 23*a* and a lower annular structure 23*b*, and the lower annular structure 23*b* is connected to the surrounding wall 212 of the hub 21, for example. The hub 21 further includes a connection portion 213. In detail, the connection portion 213 is shaped like a protrusion or platform extending from the surrounding wall 212. The lower annular structure 23*b* has a plurality of screw holes, and the connection portion 213 of the hub 21 and the lower annular structure 23*b* are connected by at least a screw S passing through the screw hole. However, the invention is not limited thereto.

The heat dissipating structure 3 is disposed outside the hub 21, and in detail, is disposed on the top portion 211 of the hub 21. The top portion 211 of the hub 21 has at least a heat dissipating hole 214. As shown in FIG. 2, the heat dissipating structure 3 includes a baffle 31 and at least an inner blade for called second blade) 32. The inner blade 32 extends from the baffle 31 perpendicularly and is disposed corresponding to the heat dissipating hole 214. In this embodiment, the top portion 211 of the hub 21 includes four heat dissipating holes 214, and each of them is disposed corresponding to two inner blades 32, wherein the heat dissipating structure 3 of this embodiment includes eight inner blades 32. However, the invention is not limited thereto. Besides, the hub 21 includes at least a recess 215 that extends from the heat dissipating hole 214 and toward a radial direction and is formed on the surface of the top portion 211 of the hub 21. The inner blades 32 are wedged in the recesses 215 and disposed over the heat dissipating holes 214. In other words, the bottom of the inner blade 32 is partially disposed in the recess 215 while partially disposed over the heat dissipating hole 214. In this embodiment, the recesses 215 corresponds to the inner blades 32 in number, so there are totally eight recesses 215 for receiving the inner blades 32 in order to fix the inner blades 32, and therefore the inner blades 32 can be prevented from slipping and vibrating during the operation of the fan F.

Figure 3:
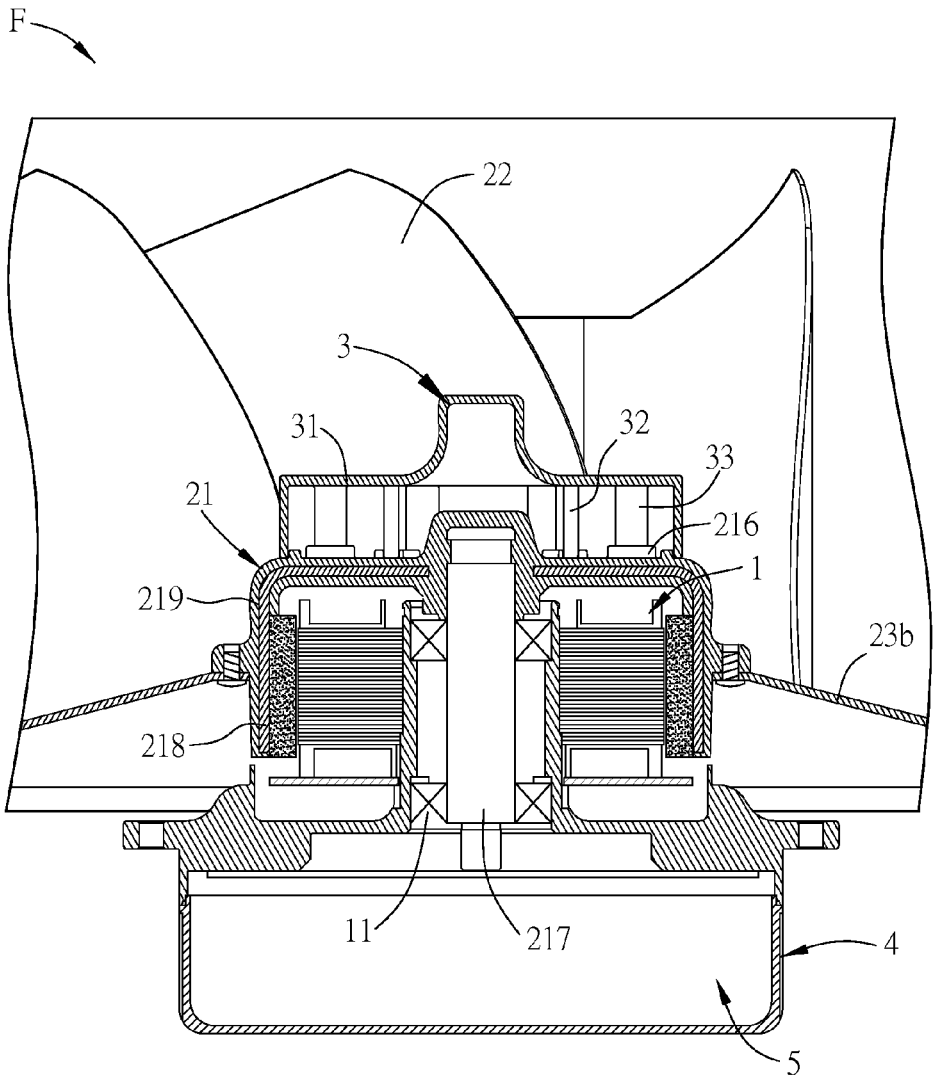
FIG. 3 is an enlarged diagram of a part of the fan in FIG. 1B.

As shown in FIG. 2, the hub 21 includes at least a first fixing portion 216, the heat dissipating structure 3 includes at least a second fixing portion 33, and the first fixing portion 216 is connected to the second fixing portion 33 (see FIG. 3). In this embodiment, the second fixing portion 33 is a screw pillar extending downward from the baffle 31, and the extending direction thereof is parallel to the inner blade 32. The first fixing portion 216 and the second fixing portion 33 are the corresponding ones so as to be connected together by screwing. In other embodiments, the first fixing portion 216 and the second fixing portion 33 can be connected to each other, for example, by riveting or soldering. However, the invention is not limited thereto.

FIG. 3 is an enlarged diagram of a part of the fan in FIG. 1B. As shown in FIGS. 1B and 3, the impeller 2 is connected to the motor 1, so the impeller 2 is driven by the motor 1 when the fan F operates. The hub 21 includes a shaft 217 and an iron shell 218. In this embodiment, the shaft 217 and the iron shell 218 are integrally formed as one single piece by die-casting to a main body 219 of the hub 21. To be noted, the main body 219 of the hub 21 is defined as the main structure of the hub 21 including the top portion 211, the surrounding wall 212, the connection portion 213, the heat dissipating hole 214, the recess 215 and the first fixing portion 216 (see FIG. 2). They are collectively called the main body 219 for a concise purpose. In detail, the shaft 217, the iron shell 218 and main body 219 are integrally formed by injection molding as the whole structure of the hub 21, and the connection between the shaft 217 and iron shell 218 and the main body 21 is formed by die-casting. The material of the main body 219 of the hub 21 is light metal, and is aluminum preferably. In this embodiment, the shaft 217 and the iron shell 218 are both iron components, and they are integrally formed with the main body 219 by injection molding as the whole structure. Besides, the connection between the shaft 217, the iron shell 218 and the main body 21 is strengthened by die-casting. In comparison with the prior art where the connection between the iron shaft and the plastic hub is achieved by riveting, tight fit or adding iron rings, the connection between the shaft 217 and the main body 21 of this embodiment is strengthened by die-casting to be made stronger.

Figure 4:
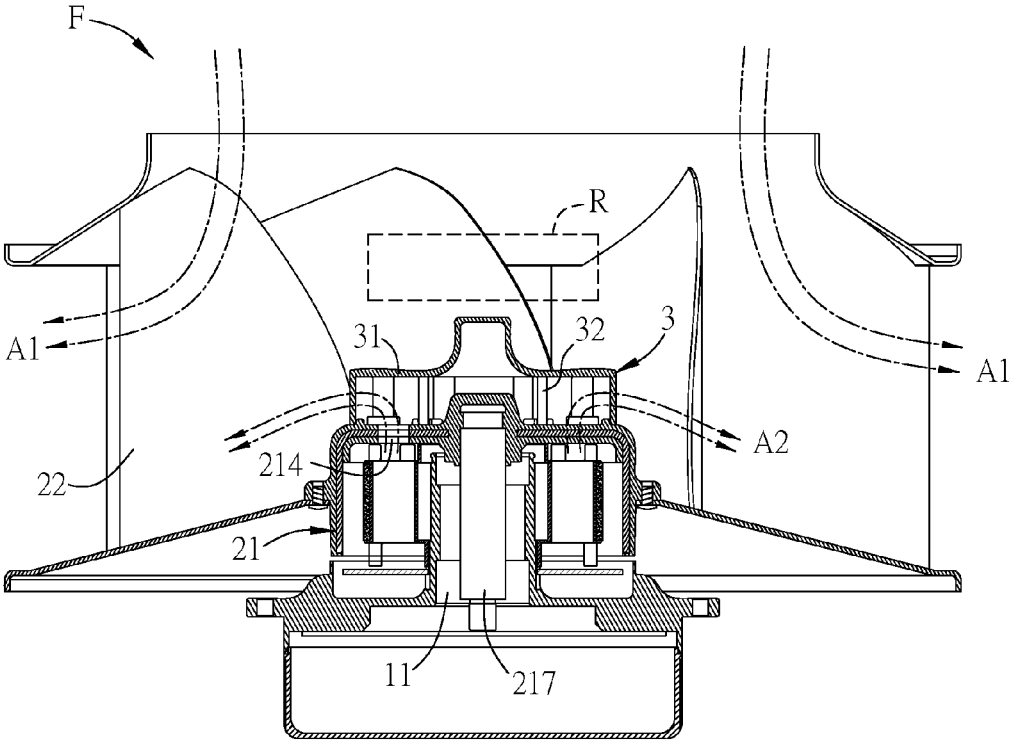
FIG. 4 is a schematic diagram showing the flowing direction of the airflow of the fan in FIG. 1B.
Figure 5:
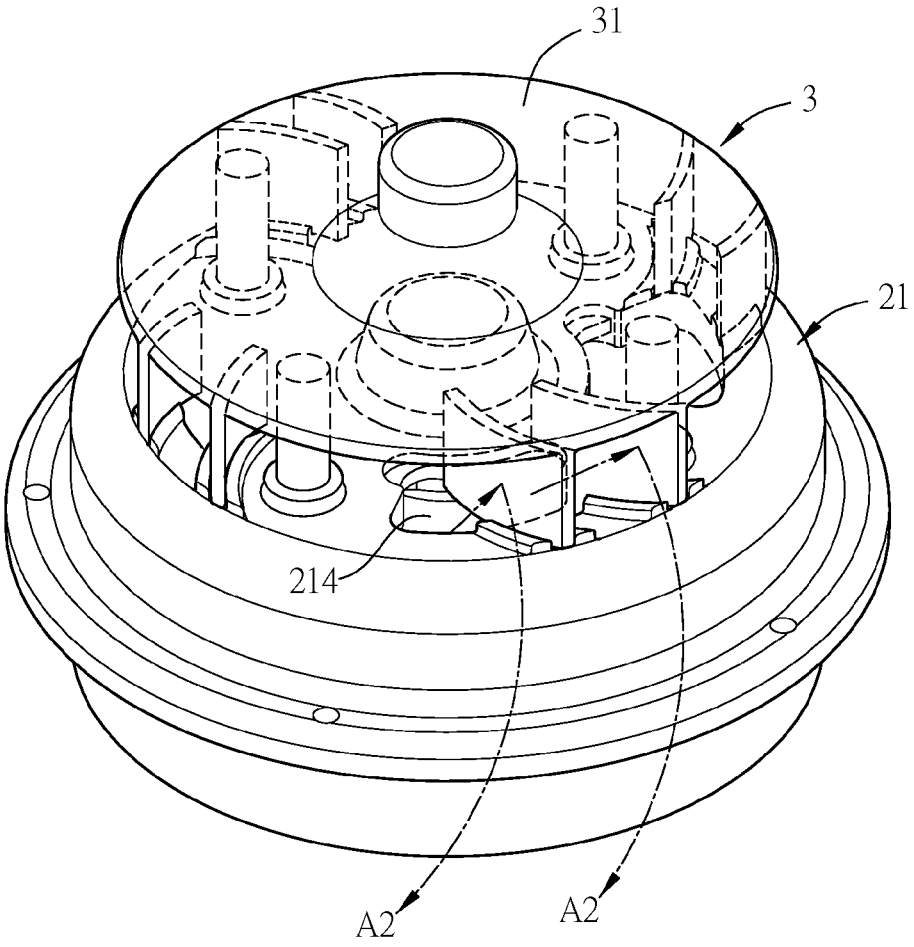
FIG. 5 is a schematic diagram of the hub and heat dissipating structure in FIG. 2.

The motor 1 further includes a bearing 1, and the shaft 217 of the hub 21 is supported by the bearing 11. When the motor 1 operates, the hub 21 is driven to rotate and the impeller 2 is further driven to rotate. FIG. 4 is a schematic diagram showing the flowing direction of the airflow of the fan in FIG. 1B, and FIG. 5 is a schematic diagram of the hub and heat dissipating structure in FIG. 2. As shown in FIGS. 3 to 5, when the impeller 2 is driven to rotate, the outer blades 22 rotate to generate the first airflow A1. Meanwhile, the inner blades 32 are driven by the hub 21 to rotate to generate the second airflow A2 within the hub 21 and motor 1, and thus the heat generated by the motor 1 can be dissipated outward through the heat dissipating holes 214 (see FIGS. 4 and 5). Therefore, the coil of the motor 1 can be heat-dissipated.

Generally, a conventional centrifugal fan has some large-angle bending structure at the inlet and outlet of the impeller, so the turbulent flow is easily generated, thereby resulting in the hindrance of the flow field and reduction of efficiency. For the fan as shown in FIG. 4, the connection of the impeller 2 and hub 21 is closer to the inner blades 32; in other words, the lower annular structure 23*b* and the connection portion 213 are closer to the inner blades 32. Besides, the lower annular structure 23*b* connected to the hub 21 further includes an inclined surface. By the above-mentioned disposition and design, the first airflow A1 can be made smoother, and thus the turbulence generated due to the turning of the airflow can be reduced.

Moreover, when a conventional fan operates, a stagnant region will be formed over the hub due to the stationary air. The hub 21 of the fan of the invention includes the heat dissipating holes 214, and the heat dissipating structure 3 is disposed to the hub 21 corresponding to the heat dissipating holes 214 for generating the second airflow A2. Therefore, the air within the motor can flow out through the heat dissipating holes 214 under the guidance of the second airflow A2 by the rotation of the impeller 2. Thus, the stagnant region and turbulence with the accompanying noise can be diminished in the invention more than the conventional fan.

Due to the design of the baffle 31, the flowing path of the second airflow A2 through the heat dissipating holes 214, the inner blades 32 and the baffle 31 constitute a complete channel. Moreover, the air above the heat dissipating structure 3 will not be drawn by the second airflow A2 due to blocking of the baffle 31, so the second airflow A2 totally originates from the air within the motor 1, thereby effectively dissipating the heat generated by the motor 1.

In this embodiment, the inner blade 32 is a curvature-type blade, and the curvature directions of the curvatures of the inner blade 32 and outer blade 22 are the same. Therefore, when the blades 22 rotate, the inner blades 32 rotate in the same direction as the outer blades and thus a reverse flow field, i.e. the second airflow A2, is generated in the area of the heat dissipating hole 214, drawing out the heat generated by the motor 1 disposed inside the hub 21 to increase the heat dissipating efficiency on the motor 1. Besides, the shape of the recess 215 corresponds to that of the bottom of the inner blade 32. In other words, the recess 215 has a particular curving shape according to the curvature curvature of the inner blade 32. Thus, the inner blade 32 can be wedged in the recess 215 in a particular orientation to ensure that the orientation of the inner blade 32 is identical to that of the outer blade 22 when the heat dissipating structure 3 is installed to the hub 21. Therefore, the wrong installation, which is unable to generate the reverse flow field, can be avoided.

The fan F of the embodiment further includes a base 4. The motor 1 is disposed on the base 4, and the motor 1 and the base 4 define an accommodating space 5 for accommodating other electronic components therein.

Generally, for a conventional fan having a diameter of 360 mm operating at the output power of 720 W, the rotation speed of 2000 RPM and the room temperature about 20° C. for 10 minutes, the temperature of the coil of the motor can achieve 100° C. and continuously increased. Contrarily, for the fan F of this embodiment operating in the same condition for 10 minutes, the temperature of the coil of the motor 1 can be steadily maintained under 50° C., which shows the heat generated by the motor 1 during the operation is indeed removed.

In summary, due to the design of the heat dissipating hole formed on the hub of the fan and heat dissipating structure disposed outside the hub in the invention, the heat dissipating structure with its inner blades is driven to rotate as the motor drives the hub to rotate, resulting in the convection effect within the motor and area of the hub to generate the second airflow. Accordingly, the heat generated by the motor can be dissipated out through the heat dissipating hole, the heat from the coil of the motor can be heat-dissipated, and the temperature of the bearing can be lowered down. Therefore, the lifespan of the motor and its bearing can be increased.

Furthermore, the air within the motor is guided by the second airflow and then flows out from the heat-dissipating hole clue to the rotation of the impeller. Thus, compared with the conventional fan, the stagnant region and turbulence with the accompanying noise can be diminished in the present invention. Because the second airflow generated by the inner blades concerns the internal disturbance of the fan, the power consumption resulted from the second airflow is negligible. Therefore, the disposition of the heat dissipating structure won't affect the characteristic of the fan or increase the additional power consumption.

Moreover, besides dissipating the heat generated by the motor, the disposition of the heat dissipating holes also can decrease the total weight of the hub.

Besides, if the inner blade is an curvature-type blade, and the curvature directions of the inner and outer blades are the same, the inner blades rotate in the same direction as the outer blades when the outer blades rotate, and thus a reverse flow field, i.e. the second airflow, is generated in the area of the heat dissipating hole, drawing out the heat generated by the motor disposed inside the hub to increase the heat dissipating efficiency on the motor.

Although the invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fail within the true scope of the invention.

What is claimed is:

1. A fan comprising:

a motor;

an impeller comprising:

a hub receiving the motor and comprising at least a heat dissipating hole; and a plurality of first blades disposed around the hub; and a heat dissipating structure disposed outside the hub, and having a baffle and at least a second blade that extends from the baffle corresponding to the heat dissipating hole, wherein the hub includes at least a recess extending from the heat dissipating hole and the second blade is wedged in the recess, and shape of the recess corresponds to that of the bottom of the second blade.

2. The fan according to claim 1, wherein the second blade is partially disposed in the recess and partially disposed over the heat dissipating hole.

3. The fan according to claim 1, wherein the hub further comprises at least a first fixing portion, the heat dissipating structure includes at least a second fixing portion, and the first fixing portion is connected to the second fixing portion.

4. The fan according to claim 3, wherein the first fixing portion and the second fixing portion are connected to each other by screwing, riveting or soldering.

5. The fan according to claim 1, wherein the first blade and the second blade are curvature-type blades.

6. The fan according to claim 1, wherein curvature directions of the first and second blades are the same.

7. The fan according to claim 1, wherein the impeller further comprises two annular structures, the first blades are disposed between the annular structures, and one of the annular structures is connected to the hub.

8. The fan according to claim 7, wherein one of the annular structures has a plurality of screw holes and is connected to the hub in a screwing way.

9. The fan according to claim 7, wherein the annular structure connected to the hub includes an inclined surface.

10. The fan according to claim 1, wherein the hub comprises a shaft and an iron shell.

11. The fan according to claim 10, wherein the shaft and the iron shell are integrally formed as one piece with a main body of the hub by die-casting.

12. The fan according to claim 1, wherein the material of the hub comprises a light metal or aluminum.

13. The fan according to claim 1, further comprising a base, wherein the motor is disposed on the base, and the motor and the base define an accommodating space for accommodating an electronic component.

* * * * *